United States Patent [19]
Horiuchi et al.
[11] 4,365,466
[45] Dec. 28, 1982

[54] POLYESTER SPUN-LIKE TEXTURED YARN AND METHOD FOR MANUFACTURING THE SAME

[75] Inventors: Takumi Horiuchi; Yoji Kuroda; Kenji Hukatsu, all of Matsuyama, Japan

[73] Assignee: Teijin Limited, Osaka, Japan

[21] Appl. No.: 281,871

[22] Filed: Jul. 9, 1981

[30] Foreign Application Priority Data

Jul. 15, 1980 [JP] Japan ..... 55-95597

[51] Int. Cl.³ ..... D02G 1/02; D02G 3/24

[52] U.S. Cl. ..... 57/205; 57/207; 57/208; 57/245; 57/247; 57/288; 57/908; 428/370; 428/373

[58] Field of Search ..... 57/205, 204, 207, 208, 57/245–247, 287, 288, 350, 908; 428/369, 370, 373, 375

[56] References Cited

U.S. PATENT DOCUMENTS 3,691,750 9/1972 Waters ..... 57/205
4,145,870 3/1979 Klee et al. ..... 57/288
4,164,117 8/1979 Talbot ..... 57/245 X
4,170,867 10/1979 Leininger ..... 57/245
4,226,079 10/1980 Mountney et al. ..... 57/288
4,295,329 10/1981 Windley ..... 57/245
4,296,597 10/1981 Tani et al. ..... 57/205
4,307,565 12/1981 Sasaki et al. ..... 57/205

*Primary Examiner*—John Petrakes
*Attorney, Agent, or Firm*—Burgess, Ryan and Wayne

[57] ABSTRACT

A polyester spun-like textured yarn comprising: a core portion; and a wrapper portion continuously and alternately wrapping about the core portion. The core portion comprises a polyester multifilament yarn (A) which is not dyeable with ionic dyes. The wrapper portion comprises polyester multifilament yarns (B) and (C) which are entangled with each other. The yarn (B) is not dyeable with ionic dyes, and the yarn (C) is dyeable with ionic dyes. Some of the filaments constituting the wrapper portion are entangled and interlaced with some of the filaments constituting the core portion in the boundary region between the core and wrapper portions.

7 Claims, 3 Drawing Figures

POLYESTER SPUN-LIKE TEXTURED YARN AND METHOD FOR MANUFACTURING THE SAME

BRIEF DESCRIPTION OF THE INVENTION

The present invention relates to a polyester spun-like textured yarn which has a hand like that created in spun yarns and which provides a woven or knitted fabric having a deep and splendid heather-like appearance either when the fabric is dyed after it is manufactured or when the yarn is dyed before the fabric is manufactured. Furthermore, the present invention relates to a method for industrially manufacturing such a spun-like textured yarn.

BACKGROUND OF THE INVENTION

Conventionally, there is a method for manufacturing a polyester textured yarn which creates a heather-like appearance when it is subjected to a dyeing operation (Japanese patent laid-open No. 61758/73). In this method, a polyester multifilament yarn which is dyeable with ionic dyes is mixed with a polyester multifilament yarn which is not dyeable with ionic dyes, and then, the mixed yarns are subjected to an interlacing treatment in a turbulent fluid flow, and thereafter, the interlaced yarns are false twisted. Although the textured yarn obtained through the above-mentioned method has a heather-like appearance, it has a disadvantage in that it does not have a hand similar to that created by a spun textured yarn.

German patent application P2902949 discloses a method wherein multifilament yarns having different breaking elongations are used so that the multifilament yarn with a smaller breaking elongation constitutes the core portion and the multifilament yarn with a larger breaking elongation constitutes the wrapper position. Accordingly, the spun-like effect of the obtained yarn is increased. However, if such a yarn is dyed, the color tone of the core portion is conspicuous, and as a result, there occurs another disadvantage in that the yarn has an inferior heather-like appearance.

In conclusion, at present, there is no textured polyester yarn having both a good heather-like appearance and a spun-like effect, and therefore, the development of such a textured yarn has been desired in this field.

SUMMARY OF THE INVENTION

In order to provide a polyester spun-like textured yarn which is free from the above-described disadvantages and which has a good heather-like appearance and a splendid hand like a spun textured yarn, the inventors of the present invention have earnestly conducted basic research. As a result, they have achieved the present invention, i.e., (1) a polyester spun-like textured yarn having a novel double layered structure which is apparently different from that of the conventional one and (2) a method for effectively and industrially manufacturing such a spun-like textured yarn.

More specifically, the polyester spun-like textured yarn of the present invention is characterized in that the yarn comprises: a core portion comprising a polyester multifilament yarn (A) which is not dyeable with ionic dyes; and a wrapper portion comprising a polyester multifilament yarn (B) which is not dyeable with ionic dyes and a polyester multifilament yarn (C) which is dyeable with ionic dyes and continuously wrapped about the core portion in an alternately twisted condition, wherein the multifilament yarn (B) and the multifilament yarn (C) are randomly mixed and entangled with each other in the wrapper portion and wherein some of the filaments constituting the wrapper portion are entangled and interlaced with some of the filaments constituting the core portion in the boundary region between the core portion and the wrapper portion in order to form an interlaced portion.

Furthermore, the method for manufacturing a polyester spun-like yarn of the present invention is characterized by: doubling a partially oriented polyester multifilament yarn (a) which has a breaking elongation of between 100 and 250% and which is not dyeable with ionic dyes, an undrawn polyester multifilament yarn (b) which has a breaking elongation of at least 250%, the breaking elongation being higher than that of the partially oriented polyester multifilament yarn (a) by at least 80%, and which is not deyeable with ionic dyes, and an undrawn polyester multifilament yarn (c) which has a breaking elongation of at least 250%, the breaking elongation being higher than that of the partially oriented polyester multifilament yarn (a) by at least 80%, and which is dyeable with ionic dyes; subjecting the three multifilament yarns (a), (b) and (c) to an interlacing treatment by means of a turbulent fluid flow in order to mix them; and simultaneously drawing and frictionably false twisting the mixed multifilament yarns (a), (b) and (c) at a draw ratio of at least 1.2.

DETAILED DESCRIPTION OF THE INVENTION

The term "a polyester multifilament yarn which is not dyeable with ionic dyes" used herein generally means a multifilament yarn which is composed of either polyethylene terephthalate or polyethylene terephthalate with a small amount of a third component (for example, isophthalic acid, adipic acid and propylene glycols) having no affinity for ionic dyes copolymerized therewith and which is substantially not dyed with ionic dyes, such as acid dyes or basic dyes. Contrary to this, the term "a polyester multifilament yarn which is dyeable with ionic dyes" used herein generally means a multifilament yarn which is composed of either a polyester containing groups, such as sulfonate groups, dyeable with ionic dyes or a polyester blended with a polymer, such as nylon 6 or nylon 66, or additives dyeable with ionic dyes and which is dyeable with ionic dyes. The desirable polyester dyeable with ionic dyes is a copolymerized polyethylene terephthalate including 0.5~10 mol % of 5-sulfosodium isophthalic acid as an acid component.

The spun-like textured yarn of the present invention is a double layered yarn which comprises: a core portion (a core yarn) comprising a polyester multifilament yarn (A) which is not dyeable with ionic dyes; and a wrapper portion (a sheath yarn) comprising a polyester multifilament yarn (B) which is not dyeable with ionic dyes and a polyester multifilament yarn (C) which is dyeable with ionic dyes and together continuously wrapped about the core portion. Some of the filaments constituting the wrapper portion are entangled and interlaced with some of the filaments constituting the core portion in the boundary region between the core portion and the wrapper portion. In addition, when the sheath yarn (wrapper portion) comprising the multifilament yarns (B) and (C) is observed as a whole, the sheath yarn alternately wraps about the core yarn (core portion). It is preferable that the wrapper yarn continuously and alternately wrap about the core yarn.

The above-mentioned German Patent Application P2902949 discloses a spun-like double layered yarn, the core and wrapper portions of which are composed of polyester multifilament yarns having the same chemical composition. Contrary to this, according to the present invention, the alternately wrapped wrapper yarn which constitutes the sheath portion must be composed of a polyester multifilament yarn (B) which is not dyeable with ionic dyes and a polyester multifilament yarn (C) which is dyeable with ionic dyes. If such a combination is applied to the wrapper yarn, the spun-like yarn of the present invention can achieve both a heater-like effect and a spun-like effect.

It should be noted that if multifilament yarns (B) and (C) for constituting the sheath portion satisfy the requirements regarding the dyeability with ionic dyes, they are not limited to two kinds and they may be three kinds or more. For example, either one of the multifilament yarns (B) and (C) or both of them may be a blended yarn comprising two or more kinds of multifilament yarns, which differ in their deniers of individual filaments, their cross sectional shapes, or their amounts of delustering agents.

In the sheath portion, i.e., wrapper yarn, the multifilament yarns (B) and (C) must be randomly mixed and entangled with each other in order to achieve a good heather-like appearance.

Regarding the core portion, i.e., core yarn, the number of the polyester multifilament yarns is not limited to one. If they are substantially not dyeable with ionic dyes, two or more kinds of multifilament yarns which differ in their deniers of individual filaments or their cross sectional shapes may be used in a form of a blended yarn or a piled yarn. In addition, a part of the core yarn may include filaments dyeable with ionic dyes. It is preferable that the polyester multifilament yarn (A) constituting the core portion has a breaking elongation of at least 25%.

The denier arrangement of multifilament yarns (A), (B) and (C) constituting a spun-like yarn of the present invention should appropriately be determined, taking into consideration the color tone which is required of a spun-like textured yarn with a heather-like appearance and the final demands. With regard to deniers of the individual filaments, the polyester multifilament yarn (A) constituting the core portion is preferably at least 3 denier, and the polyester multifilament yarns (B) and (C) constituting the sheath portion is preferably at most 3 denier, when bulk, soft feeling of the surface, rigidity and stiffness of woven or knitted fabric obtained by using the spun-like yarn are taken into consideration.

Furthermore, if the individual total deniers of the constituent multifilament yarns (A), (B) and (C) satisfy the following condition, the obtained spun-like yarn has a splendid heather-like appearance.

$$A:B:C=30\sim70:15\sim50:10\sim40$$

wherein $A+B+C=100$, and therefore, $B+C=70\sim30$.

A spun-like textured yarn has a double layered structure comprising a core portion (core yarn) and a sheath portion (wrapper yarn) as explained above. The sheath portion continuously and alternately wraps about the core portion. Besides, in the boundary region between the core portion and the sheath portion, some of individual filaments constituting the sheath and core portions are entangled and interlaced with each other to form an interlaced portion, and as a result, the spun-like yarn is united in one body.

DETAILED DESCRIPTION OF THE EMBODIMENTS

Figure 1:
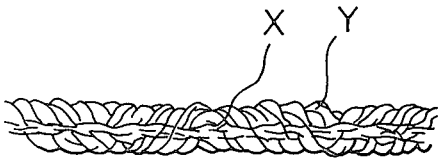
FIG. 1 is an enlarged side view of a polyester spun-like textured yarn of the present invention comprising two or more kinds of polyester multifilament yarns.

Referring to FIG. 1 which illustrates an enlarged side view of an embodiment of a polyester spun-like textured yarn of the present invention having a double layered structure, symbol X denotes a core portion which is composed of a polyester multifilament yarn (A) not being dyeable with ionic dyes, and symbol Y denotes a wrapper portion which is composed of a polyester multifilament yarn (B) not being dyeable with ionic dyes and a polyester multifilament yarn (C) being dyeable with ionic dyes, filament of the yarns (B) and (C) are mixed with each other.

The most characteristic matter which will be noted from FIG. 1 is that there is substantially no location where the wrapper portion Y completely wraps about the core portion X beyond one turn, which location is usually referred to as a helically wrapping portion. Instead, if the wrapper portion Y is macroscopically observed, it is continuously alternated, and portions twisted in S and Z directions wrap about the core portion for less than 360°. Furthermore, since part of the filaments constituting the wrapper portion are randomly entangled and interlaced with the core portion, the core portion and the wrapper portion are highly bound and united with each other, even though the wrapper portion is wrapped alternately, i.e., incompletely wrapped.

Since the polyester spun-like textured yarn of the present invention has such a particular double layered structure as explained above, it has a spun-like hand similar to that of a spun textured yarn. In addition, in the wrapper portion which alternately wraps about the core portion, filaments not dyeable with ionic dyes and filaments dyeable with ionic dyes are mixed, and accordingly, if the obtained spun-like yarn is dyed in a dye liquor containing ionic dyes or if the fabric produced by utilizing such spun-like yarn is dyed in a dye liquor containing ionic dyes, a deep leather-like appearance can be realized.

A more detailed explanation will now be continued. In the above-mentioned alternately twisted structure, the effect created by a unidirectionally fully wrapped wrapper yarn is decreased. However, the wrapper portion alternately wraps about the core portion at a relatively short pitch, and therefore, an appropriate wrapping effect can be maintained. In addition, it should be pointed out that, since the wrapper portion loosely wraps about the core portion relative to the unidirectionally and fully wrapped yarn, and since the wrapper portion as a whole is alternated, a spun-like hand, i.e., bulkiness an soft-touch, is realized. Although the double layered structure appears as if it is unstable, the spun-like yarn as a whole is extremely stable, especially stable against rubbing, because the filaments constituting the wrapper portion and the core portion are partially entangled and interlaced. In the wrapper portion, since filaments not dyeable with ionic dyes and filaments dyeable with ionic dyes are randomly mixed, a good heather-like appearance can be obtained when the textured yarn is dyed with ionic dyes or when a fabric woven or knitted from such a textured yarn is dyed with ionic dyes.

When a core portion of a textured yarn is constituted with a multifilament yarn dyeable with ionic dyes, a desirable heather-like appearance cannot be achieved. Therefore, the spun-like textured yarn having a core portion consisting of a multifilament yarn dyeable with ionic dyes is excluded from the scope of the present invention.

Figure 2:
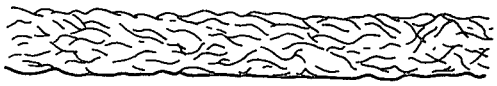
FIG. 2 is an enlarged side view of another composite textured yarn which is not included in the present invention.

When a textured yarn does not have an alternate twisted structure, and even if the textured yarn has an appearance similar to that of FIG. 2, its spun-like effect and heather-like appearance are reduced.

A method for industrially manufacturing the above-explained polyester spun-like textured yarn will now be explained. According to the present invention regarding this method, three kinds of yarns, i.e., a partially oriented polyester multifilament yarn (a) which has a breaking elongation of between 100 and 250% and which is not dyeable with ionic dyes; an undrawn polyester multifilament yarn (b) which has a breaking elongation of at least 250% and which is not dyeable with ionic dyes; and an undrawn polyester multifilament yarn (c) which has a breaking elongation of at least 250% and which is dyeable with ionic dyes, and the differences in breaking elongations between (a) and (b), and (a) and (c) are at least 80% (preferably, at least 100%), are doubled first. If the breaking elongation of the yarn (a) is less than 100%, yarn breakages frequently occur while a draw-texturing operation takes place at a draw-ratio equal to or more than 1.2. If the breaking elongation of the yarn (a) exceeds 250%, the yarn which constitutes the sheath portion does not wrap well, and accordingly, the spun-like effect is decreased. If the breaking elongation of either yarn (b) or yarn (c) is less than 250%, or if the difference in the breaking elongations of either the yarns (a) and (b), or (a) and (c) is less than 80%, the wrapping of the wrapper portion Y around the core portion X is deteriorated, and accordingly, an alternately twisted structure cannot be achieved.

Then, while the three yarns ar doubled, or after they are doubled, they are introduced into a turbulent air flow and subjected to an interlacing treatment, and thereafter, they are simultaneously drawn and friction false twisted at a draw ratio of at least 1.2. In this instance, the interlacing treatment in a turbulent fluid flow must take place before the simultaneous draw and false twist texturing takes place. Contrary to this, if the turbulent fluid treatment takes place after the simultaneous draw and false twist texturing takes place, a good spun-like textured yarn cannot be produced because of the inferior intermingling between the wrapper portion and the core portion, since the wrapper portion may slip along the core portion while thay are subjected to the texturing. The interlacing treatment is preferably effected under such a condition that the interlacing degree of the obtained yarn is between 20 and 80 per one meter. If the interlacing degree is smaller than 20 per one meter, the separation between the core portion X and the wrapper portion Y in the obtained textured yarn may easily occur, and the mixing of filaments constituting the multifilament yarns (B) and (C) in the wrapper yarn Y becomes insufficient. Accordingly, the heather-like effect is decreased. Contrary to this, if the interlacing degree exceeds 80 per meter, the properties of the obtained yarn are degraded.

The "interlacing degree" used herein is measured in accordance with the hook drop method disclosed in U.S. Pat. Nos. 2,985,991 and 3,110,151.

The draw ratio applied during the simultaneous drawing and false twisting treatment must be at least 1.2, preferably of between 1.3 and 2.0. If the draw ratio is less than 1.2, a good alternately twisted wrapper structure cannot be expected.

It is preferable that the tension in the yarn while it is treated is determined, so that the ratio of the tension $T_2$ in the yarns located at the detwisting side of the tension $T_1$ in the yarns located at the twisting side satisfies $0.5 \leqq T_2/T_1 \leqq 0.9$. If the ratio $T_2/T_1$ exceeds 0.9, the yarns may be separated from each other, because the detwisting force increases. Accordingly, when a fabric is woven with such a yarn, the woven fabric does not have a voluminous feeling and dye-specks may occur, and therefore a ratio $T_2/T_1$ of more than 0.9 is not desirable. Contrary to this, if the ratio $T_2/T_1$ is less than 0.5, the obtained spun-like yarn may become hard. Accordingly, if such a yarn is woven in a fabric, the hand of the produced fabric is inferior. In addition, the ability of the yarn to be treated is lowered due to the hardness thereof. Therefore, the ratio $T_2/T_1$ of less than 0.5 is undesirable.

The treating speed may be voluntarily determined. However, it should be pointed out that the treatment can be performed at a speed equal to or higher than 250 m/min in accordance with the present invention.

Figure 3:
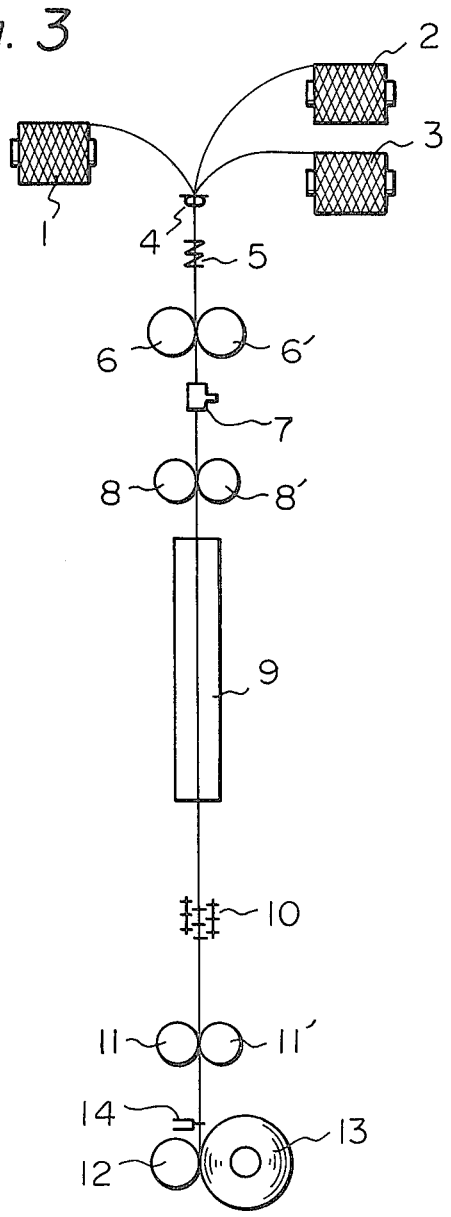
FIG. 3 is a schematic side view of a texturing apparatus for simultaneously drawing and friction false twisting wherein a method of the present invention is carried out.

In FIG. 3 illustrating a schematic side view of a texturing apparatus for simultaneously drawing and friction false twisting for carrying out the method of the present invention, 1 denotes a package of a partially oriented polyester multifilament yarn (a) manufactured through high speed spinning, having a breaking elongation of between 100 and 250% and not being dyeable with ionic dyes. Reference numeral 2 denotes a package of an undrawn polyester multifilament yarn (b) having a breaking elongation of at least 250% and not being dyeable with ionic dyes. Reference numeral 3 denotes a package of an undrawn polyester multifilament yarn (c) having a breaking elongation of at least 250% and being dyeable with ionic dyes. Three yarns withdrawn from the packages 1, 2 and 3 are doubled at the guide 4 and are fed to a turbulent air nozzle 7 for mixing and interlacing through a tension regulator 5 and a pair of feed rollers 6 and 6', in which nozzle an interlaced yarn having an interlacing degree of between 30 and 100 per meter is produced. Then, the interlaced yarn is fed to a drawing and false twisting zone by means of a pair of first delivery rollers 8 and 8'. Passing by a heater 9 and an outer friction false twister 10 of three shaft type with a plurality of discs, the yarn is delivered by means of a pair of second delivery rollers 11 and 11' and then is taken up into a cheese 13 by means of a winder 12. Reference numeral 14 denotes a traverse device for moving the yarn to and fro.

It is preferable to use an interlacing nozzle which is widely utilized in this field for the turbulent air nozzle; however, a "Taslan" nozzle may also be used for the turbulent air nozzle. The yarn, which has been subjected to an interlacing treatment by means of turbulent air, can be once wound around a bobbin in some cases, and then it is subsequently subjected to the simultaneous drawing and false twisting treatment. However, in many cases, the yarn which has been subjected to an interlacing treatment can successively be subjected to the simultaneous drawing and false twisting treatment without being taken up onto bobbin before the drawing and false twisting treatment.

It is also preferable that an outer friction false twister of the three shaft type with a plurality of discs illustrated in FIG. 3 should be used as a friction false twister, because it serves both to false twist the yarn and to feed the yarn. In this case, it is possible to dispose one or more discs with rough surfaces at the yarn feed entrance, as disclosed in German patent application No. P2902949, so that part of the filaments constituting the wrapper portion Y are cut and raised by contacting them with the surface of the discs. Accordingly, a spun-like textured yarn having fluff can be produced.

As explained above, according to the present invention, an improved polyester spun-like yarn which realizes a heather-like appearance when it is dyed with ionic dyes can be produced by which a woven or knitted fabric having an appropriate hand created by the twisted yarn, and appropriate bulkiness and softness can be provided. Furthermore, such a textured yarn can stably be manufactured at a high speed, and the obtained textured yarn is free from any neps when it is rubbed. In addition, when such a textured yarn is used for weaving or knitting, the productivity of the weaving or knitting operation can be increased, and a woven or knitted fabric having a high quality can be obtained.

Especially, the spun-like yarn produced by the above-explained method has such a structure that the sheath portion alternately wraps about the core portion. The molecular orientations of the multifilament yarns (B) and (C) are relatively low. Accordingly, when the yarn is dyed, the color tone is good, and the heather-like appearance is much superior to that obtained by a conventional method. As a result, the polyester spun-like textured yarn of the present invention is in demand for outer wear clothing, which needs ornamental beauty, and for furnishing fabrics, such a curtains.

It is possible to weave or knit the polyester spun-like textured yarn of the present invention together with another yarn. In this case, the combination is selected so that the heather-like appearance and the spun-like effect of the polyester spun-like textured yarn of the present invention is fully utilized. Therefore, a woven or knitted fabric having a splendid hand and an appearance which are different from those achieved by the conventional method can be produced.

The present invention will now be explained in detail with reference to an Example of the present invention and comparisons.

EXAMPLE

A partially oriented polyethylene terephthalate yarn (225 de/30 fil) obtained through high speed spinning, the spinning speed of which was 3400 m/min, and having a breaking elongation of 150%; an undrawn polyethylene terephthalate yarn (85 de/24 fil) obtained through spinning, the spinning speed of which was 1200 m/min, and having a breaking elongation of 370%; and an undrawn polyethylene terephthalate yarn copolimerized with sulfosodium isophthalic acid (135 de/48 fil, dyeable with cationic dyes) were doubled and then were subjected to an interlacing treatment and a simultaneous drawing and friction false twisting treatment.

In this instance, the overfeed ratio between the feed roller and the first delivery roller was 0.5%, and 60 interlacing points per meter were formed by means of a turbulent air nozzle (interlacing nozzle) similar to that disclosed in FIG. 38 of U.S. Pat. No. 3,110,151 and supplied with compressed air at a pressure of 4 kg/cm$^2$. Thereafter, by means of the first delivery rollers, the interlaced yarn was fed to the drawing and false twisting zone, where it was simultaneously drawn and false twisted under the following conditions, i.e., a draw ratio, 1.49; number of the observed false twists, 2550 T/m; the temperature of the heater, 200° C.; and the speed of the second delivery rollers, 250 m/min. An outer friction false twister of three shafts with a plurality of friction discs having yarn contacting surfaces of ceramic was used, and the ratio $T_2/T_1$ was adjusted to 44 g/57 g=0.77.

The produced textured yarn had an alternately twisted structure, as illustrated in FIG. 1, and was a spun-like textured yarn having the following properties. After a fabric was woven by utilizing this yarn, it was dyed in the following conditions, and a woven fabric having a heather-like and spun-like hand with a deep heather-like appearance was produced.

| Properties of the textured yarn | | | |
|---|---|---|---|
| Denier | Strength | Breaking Elongation | Total Percentage of Crimps |
| 301 de | 1.8 g/de | 18% | 4.3% |

| Dyeing conditions | | |
|---|---|---|
| Cationic dyes | Servon Blue 5G | 2% owf |
| Glacial acetic acid | | 2% owf |
| Sodium acetate | | 1% owf |
| Bath ratio | | 1:50 |
| Dyeing temperature and time | | 120° C. × 60 min |

COMPARISON 1

A partially oriented polyethylene terephthalate yarn (116 de/15 fil) obtained through high speed spinning, the spinning speed of which was 3400 m/min, and having a breaking elongation of 160%; and an undrawn polyethylene terephthalate yarn copolymerized with sulfosodium isophthalic acid (135 de/48 fil, dyeable with cationic acid) obtained through spinning, the spinning speed of which was 1100 m/min, and having a breaking elongation of 390%, were aligned with each other. Then the aligned yarns were subjected to an interlacing treatment and a drawing and false twisting treatment in the apparatus illustrated in FIG. 3 under the same conditions as those of the Example.

The thus produced textured yarn was a spun-like yarn having an alternately twisted structure, as illustrated in FIG. 1. After a fabric was woven with this yarn, it was dyed under the same condition as those of the Example. Since the filaments dyeable with cationic dyes occurred mostly in the wrapper portion, darkly dyed portions were conspicuous, and the fabric had a poor heather-like appearance.

COMPARISON 2

A partially oriented polyethylene terephthalate copolymerized with sulfosodium isophthalic acid (225 de/30 fil, dyeable with cationic dyes) obtained through high speed spinning, the spinning speed of which was 3200 m/min, and having a breaking elongation of 150%; and an undrawn polyethylene terephthlate yarn (150 de/48 fil) obtained through spinning, the spinning speed of which was 1250 m/min, and having a breaking elongation of 390%, were aligned together and were subjected to an interlacing treatment and a drawing and false twisting treatment in the apparatus illustrated in FIG. 3 under the same conditions as those of the Example.

The thus produced textured yarn was a spun-like yarn having an alternately twisted structure, as illustrated in FIG. 1. After a fabric was woven with this yarn, it was dyed under the same conditions as those of the Example. Since the yarn dyeable with cationic dyes constituted the core yarn, it was visible inside the wrapper yarn. Accordingly, the woven fabric did not achieve a sufficient heather-like appearance.

We claim:

1. A polyester spun-like textured yarn comprising:
a core portion comprising a polyester multifilament yarn (A) which is not dyeable with ionic dyes; and
a wrapper portion comprising a polyester multifilament yarn (B) which is not dyeable with ionic dyes and a polyester multifilament yarn (C) which is dyeable with ionic dyes and together continuously wrapped about said core portion in an alternately twisted condition, wherein said multifilament yarn (B) and said multifilament yarn (C) are randomly mixed and entangled with each other in said wrapper portion and wherein some of the filaments constituting the wrapper portion are entangled and interlaced with some of the filaments constituting said core portion in the boundary region between said core portion and said wrapper portion in order to form an interlaced portion.

2. A polyester spun-like yarn according to claim 1 wherein some of the filaments constituting the outside portion of said wrapper portion are cut and raised to form fluffy free ends projecting outwards from the yarn surface.

3. A polyester spun-like yarn according to claim 1, wherein the thickness of individual filaments constituting said multifilament yarn (A) forming said core portion is at least 3 denier, the thickness of individual filaments constituting said multifilament yarns (B) and (C) forming said wrapper portion is at most 3 denier, and the ratio between the total deniers of said multifilament yarns (A), (B) and (C) satisfies the following equation and the sum of (A), (B) and (C) is 100, $$(A):(B):(C)=30\sim70:15\sim50:10\sim40.$$

4. A method for manufacturing a polyester spun-like yarn comprising:
doubling a partially oriented polyester multifilament yarn (a) which has a breaking elongation of between 100 and 250% and which is not dyeable with ionic dyes, an undrawn polyester multifilament yarn (b) which has a breaking elongation of at least 250%, said breaking elongation being higher than that of said partially oriented polyester multifilament yarn (a) by at least 80%, and which is not dyeable with ionic dyes, and an undrawn polyester multifilament yarn (c) which has a breaking elongation of at least 250%, said breaking elongation being higher than that of said partially oriented polyester multifilament yarn (a) by at least 80%, and which is dyeable with ionic dyes;
subjecting said three multifilament yarns (a), (b) and (c) to an interlacing treatment by means of a turbulent fluid flow in order to mix them; and
simultaneously drawing and frictionally false twisting the mixed multifilament yarns (a), (b) and (c) at a draw ratio of at least 1.2.

5. A method according to claim 4, wherein said interlacing treatment takes place to such an extent that the interlacing degree of the obtained polyester spun-like yarn is between 20 and 80 per one meter.

6. A method according to claim 4, wherein said mixed multifilament yarns are simultaneously drawn and frictionally false twisted under a tension ratio $T_2/T_1$ between the tension $T_1$ in the yarns located at the twisting side and the tension $T_2$ in the yarns located at the detwisting side of between 0.5 and 0.9.

7. A method according to claim 4, wherein said mixed multifilament yarns are brought into contact with at least one friction disc with a rough surface while they are simultaneously drawn and frictionally false twisted, whereby some of the filaments located at the outer surface of said mixed multifilament yarns are cut and raised.

* * * * *